US011808033B2

(12) United States Patent
McGee et al.

(10) Patent No.: US 11,808,033 B2
(45) Date of Patent: Nov. 7, 2023

(54) STRUCTURAL STUD POST WITH THERMAL BREAK

(71) Applicant: Porta-Fab Corporation, Chesterfield, MO (US)

(72) Inventors: Wayne McGee, Chesterfield, MO (US); Steve Skikas, St. Charles, MO (US); Trace Woodrum, Ballwin, MO (US)

(73) Assignee: Porta-Fab Corporation, Chesterfield, MO (US)

( * ) Notice: Subject to any disclaimer, the term of this patent is extended or adjusted under 35 U.S.C. 154(b) by 0 days.

(21) Appl. No.: 17/500,894

(22) Filed: Oct. 13, 2021

(65) Prior Publication Data

US 2022/0064943 A1 Mar. 3, 2022

Related U.S. Application Data

(63) Continuation-in-part of application No. 17/366,817, filed on Jul. 2, 2021, now Pat. No. 11,655,633, which (Continued)

(51) Int. Cl.
*E04B 2/74* (2006.01)
*E04C 3/04* (2006.01)

(Continued)

(52) U.S. Cl.
CPC ..... *E04B 2/7412* (2013.01); *E04B 1/14* (2013.01); *E04C 2/292* (2013.01); *E04C 2/34* (2013.01);

(Continued)

(58) Field of Classification Search
CPC . E04B 1/14; E04B 2/7412; E04C 3/04; E04C 3/32; E04C 3/34; E04C 2/292; E04C 2003/0452; E04C 2003/0473; Y10S 49/01
See application file for complete search history.

(56) References Cited

U.S. PATENT DOCUMENTS 835,578 A 11/1906 Tanner
835,678 A * 11/1906 Tanner ..... F16M 11/12 248/688

(Continued)

FOREIGN PATENT DOCUMENTS

| | | | |
|---|---|---|---|
| CN | 110725449 | A | 1/2020 |
| JP | 2006249683 | A | 9/2006 |
| WO | 9819025 | A1 | 5/1998 |

OTHER PUBLICATIONS

International Search Report for Application No. PCT/US2021/030679, dated Aug. 26, 2021, 3 pages.

(Continued)

*Primary Examiner* — Jessie T Fonseca
(74) *Attorney, Agent, or Firm* — Lewis Rice LLC

(57) ABSTRACT

A structural stud post assembly comprising a center receiver section having opposing receiver channels formed by side walls and angled flanges, and a pair of raceway inserts also defining a raceway channel for accepting wiring and equipment to be disposed in the raceway. The raceways can be installed in the receiver channels to accept and accommodate wiring and equipment. The center receiver comprises a thermal break at about a midpoint to prevent there from being a metal-to-metal thermally conductive pathway through the stud. The structural stud post may be used in the construction of modular building systems.

19 Claims, 13 Drawing Sheets

Related U.S. Application Data is a continuation of application No. 16/866,222, filed on May 4, 2020, now Pat. No. 11,053,680.

(51) Int. Cl.

| | |
|---|---|
| ***E04C 3/32*** | (2006.01) |
| ***E04C 2/292*** | (2006.01) |
| ***E04C 2/34*** | (2006.01) |
| ***E04B 1/14*** | (2006.01) |

(52) U.S. Cl.

CPC ..... *E04C 3/04* (2013.01); *E04C 3/32* (2013.01); *E04C 2003/0452* (2013.01); *E04C 2003/0473* (2013.01)

(56) References Cited

U.S. PATENT DOCUMENTS

| | | | |
|---|---|---|---|
| 1,085,429 | A | 1/1914 | Kahn et al. |
| 3,160,245 | A | 12/1964 | Pavlecka |
| 3,583,118 | A | 6/1971 | Lowery |
| 3,685,222 | A | 8/1972 | Curtess |
| 4,379,480 | A | 4/1983 | Kempel et al. |
| 4,435,935 | A | 3/1984 | Larrea |
| 4,754,587 | A | 7/1988 | Glaser |
| 4,936,069 | A | 6/1990 | Hunter et al. |
| 5,056,290 | A | 10/1991 | Alexander et al. |
| 5,287,675 | A | 2/1994 | McGee |
| 5,414,967 | A | 5/1995 | Cates et al. |
| 6,016,632 | A | 1/2000 | McGee et al. |
| 7,377,082 | B1 | 5/2008 | Edwards |
| 7,665,264 | B1 | 2/2010 | Wolfe |
| 9,988,811 | B2 | 6/2018 | Kalinowski |
| 11,053,680 | B1 | 7/2021 | McGee et al. |
| 2003/0226331 | A1 | 12/2003 | Lindberg et al. |

OTHER PUBLICATIONS

Written Opinion for Application No. PCT/US2021/030679, dated Aug. 26, 2021, 5 pages.

International Preliminary Report on Patentability for Application No. PCT/US2021/030679, dated Nov. 8, 2022, 6 pages.

* cited by examiner

STRUCTURAL STUD POST WITH THERMAL BREAK

CROSS-REFERENCE TO RELATED APPLICATIONS

This application is a Continuation-in-Part of U.S. patent application Ser. No. 17/366,817, filed Jul. 2, 2021, which is a continuation of U.S. patent application Ser. No. 16/866,222, filed May 4, 2020, and now issued as U.S. Pat. No. 11,053,680. The entire disclosures of all the foregoing documents are incorporated herein by reference.

BACKGROUND OF THE INVENTION

Field of the Invention

This disclosure is related to the field of modular structures. In particular, it relates to a structural stud system having a thermal break.

Description of the Related Art

The adoption rate of modular offices and in-plant buildings continues to rise in a variety of industries, ranging from industrial and medical to office settings. Modular structures are generally constructed from vertical modular panels, which serve as walls. These panels may be attached to existing floors, ceilings, or roof decks to form an in-plant structure, or otherwise secured to a solid surface, such as an existing floor system or overhead structural element. Generally, the structures are assembled by chalking out the floor plan for the structure and locating the walls. Next, a floor track is cut to plan and installed by securing it to the substrate (e.g., pavement, building floor, etc.) with a series of anchors.

Next, a plurality of structural stud posts are assembled. Prior art stud posts may be assembled from corresponding stud sections. Prior art stud sections are generally assembled with hardware. An example is shown in prior art FIG. 1. In the depicted prior art embodiment, a structural stud (101) is made by assembling two structural stud sections (103). Each section (103) has a back element (105) connected at two opposing sides to side elements (107) arranged roughly parallel to each other so that the back element (105) and side elements (107) have a U-shaped cross-section. The distal ends of each side element (107) have a flange (109) connected and extending outwardly from each side element (107), generally coplanar with each other. Two such stud sections (103) are assembled back-to-back to form a single structural stud (101). Two opposing flanges (109) on the same side of the assembly (i.e., one flange (109) from each stud section (103)) form a channel (111) for accepting the edge of a wall panel section on each opposing side of the structural stud (101).

The panels (not shown in FIG. 1) are held in place at the bottom by the floor track, and on the sides by the channels (111) formed in the sides of the studs by the flanges (109). A special stud may be used for corners so that the receiving flanges can be disposed to accept two panels at 90 degree angles from one another, as opposed to the planar arrangement shown in prior art FIG. 1. Molding may be installed on the top to secure the panel. The structural stud (101) may then be tightened, and the panels connected via hardware, to further secure the installation.

As can be seen in prior art FIG. 1, the U-shape of the stud sections (103) creates secondary cavities (113) between panels. This cavity (113), referred to in the art as a raceway, can be used to install electrical and communications wiring and related components, such as power switches, receptacles, and network connections, without compromising the integrity of the structural stud (101). For raceways (113) not used, a cover can snap on to cover the raceway and provide an attractive appearance.

One problem with modular structures is the thermal characteristics. By their nature, modular structures have structural studs that functional as building columns to transmit vertical loads to the existing floor system, but whereas the paneling between studs can be manufactured to include insulation, the studs are generally constructed of aluminum or another metal or alloy, which acts as thermal bridge, conducting excess heat as compared to the adjacent insulated elements.

This in turn introduces environmental control challenges, particularly in use cases where careful control of environmental conditions is crucial, or there are high costs associated with managing environmental conditions. For example, a grow room or cleanroom generally requires careful maintenance of temperature, light, and humidity levels, but heat loss (or penetration) through the studs can make this more difficult to manage, and increase costs. It can also introduce air quality or even structural problems by facilitating the introduction of mold, mildew, and rot. Such heat bridges can also exist in corner junctions and in other thermal discontinuities, such as beams that pass through wall assembles and convective bridges in poorly installed insulation systems. However, thermally breaking a structural stud is not a simple exercise because the stud must still retain sufficient structural integrity to serve as a primary load path for axial gravity loads, lateral out-of-plane bending loans, and in-plane seismic loads, while also accommodating the required configuration of panels.

SUMMARY

The following is a summary of the invention in order to provide a basic understanding of some aspects of the invention. This summary is not intended to identify key or critical facets of the invention or to delineate the scope of the invention. The sole purpose of this section is to present some concepts of the invention in a simplified form as a prelude to the more detailed description that is presented later.

Because of these and other problems in the art, described herein, among other things, is a structural stud post assembly having a thermal break comprising: a receiver section having a generally H-shaped central element comprising a center bar and two pairs of parallel legs extending perpendicularly from opposing sides of the center bar, each of the two pairs of legs having a pair of parallel side elements extending perpendicularly outwardly from a distal end of each leg of the each two pairs to form two opposing channels on the opposing sides of the H-shaped central element, and each of the side elements having an angled element attached thereto and extending outwardly therefrom at a first angle, and a thermal break assembly disposed within the center bar; and a raceway section having a generally U-shaped cross section comprising a bottom and two raceway legs, each of the two raceway legs having a proximal end attached to the bottom, and an opposing distal end, each of the two raceways legs extending in parallel from the bottom and having a flange perpendicularly attached to the distal end of each of the two raceway legs, the flanges being coplanar and extending outwardly from the distal ends; wherein the U-shaped cross section is sized and shaped to fit snugly into either of the two opposing channels.

In an embodiment of the structural stud post assembly, the thermal break assembly comprises an insulating structural polymer.

In another embodiment of the structural stud post assembly, the insulating structural polymer is affixed to each of the opposing pairs of parallel legs by an adhesive.

In another embodiment of the structural stud post assembly, the thermal break further comprises a pour channel sized and shaped to accept the insulating structural polymer.

In another embodiment of the structural stud post assembly, each of the opposing pairs of parallel legs are made of a metal, and pour channel comprises a removable metal bridge connecting the opposing pairs of parallel legs, wherein when the removable metal bridge is removed, the structural stud post assembly does not comprise a thermally conductive metal contact path between the opposing pairs of parallel legs.

In another embodiment of the structural stud post assembly, each of the two raceways legs comprises an angled triangular element disposed between the proximal end and the distal end of the legs, the angle triangular element extending outwardly from a midpoint of the U-shaped cross-section.

In another embodiment of the structural stud post assembly, the angled triangular element comprises an outward angled element extending outwardly from the each leg at the first angle.

In another embodiment of the structural stud post assembly, the first angle is about 45 degrees outwardly from the plane of the each leg.

In another embodiment of the structural stud post assembly, the angled triangular element comprises an inward angled element attached to the outward angled element and extending inwardly towards the each leg.

In another embodiment of the structural stud post assembly, the raceway section is generally symmetrical about a center line.

In another embodiment of the structural stud post assembly, the receiver section is generally symmetrical about a center line.

In another embodiment of the structural stud post assembly, the assembly comprises a second raceway section, the second raceway section being generally in the same configuration of the first raceway section.

In another embodiment of the structural stud post assembly, U-shaped cross-section defines a cable raceway sized and shaped to accept wiring, cabling, and electrical and communications equipment and components.

In another embodiment of the structural stud post assembly, the assembly comprises a cover sized and shaped to snap onto the raceway section.

Also described herein, among other things, is a structural stud post assembly with a thermal break comprising: two raceway sections each comprising: a raceway back element having two opposing and generally parallel vertical sides; a pair of opposing, parallel side elements each having a proximal end and an opposing distal end, the proximal end of each of the side elements attached to a corresponding one of the opposing vertical sides, each of the side elements extending generally perpendicularly from the back element, the back element and side elements forming a U-shaped cross section defining a raceway channel; a pair of outwardly angled elements each having a proximal end and an opposing distal end, the proximal end of each of the outwardly angled elements attached to the distal end of a corresponding one of the side elements, each of the outwardly angled elements extending outwardly from the raceway channel; a pair of inwardly angled elements each having a proximal end and an opposing distal end, the proximal end of each of the inwardly angled elements attached to the distal end of a corresponding one of the outwardly angled elements, each of the inwardly angled elements extending inwardly toward the raceway channel; a pair of second side elements each having a proximal end and an opposing distal end, the proximal end of each of the second side elements attached to the distal end of a corresponding one of the inwardly angled elements, each of the second side elements and extending therefrom such that the pair of second side elements are parallel to each other and each of the second side elements is coplanar with a corresponding one of the side elements; and a pair of flange elements each having a proximal end and an opposing distal end, the proximal end of each of the flange elements attached to the distal end of a corresponding one of the second side elements, each of the flange elements extending generally perpendicularly therefrom in opposing directions and the pair of flanges being coplanar; and wherein the back element, the side elements, the outwardly angled elements, the inwardly angled elements, the second side elements, and the flange elements are general in the configuration of an elongated rectangular prism having a length and the length of the back element, the side elements, the outwardly angled elements, the inwardly angled elements, the second side elements, and the flange elements is the same; and a receiver section comprising: a receiver back element having two opposing and generally parallel vertical sides; a pair of opposing, parallel receiver side elements each having a proximal end and an opposing distal end, the proximal end of each of the receiver side elements attached to a corresponding one of the opposing vertical sides, each of the receiver side elements extending generally perpendicularly from the receiver back element, the receiver back element and receiver side elements forming a U-shaped cross section defining a receiver channel; a pair of receiver outwardly angled elements each having a proximal end and an opposing distal end, the proximal end of each of the receiver outwardly angled elements attached to the distal end of a corresponding one of the receiver side elements, each of the outwardly angled elements extending outwardly from the receiver channel; a second receiver back element having two opposing and generally parallel vertical sides, the second receiver back element disposed in parallel to the receiver back element and being connected to the receiver back element by a thermal break assembly disposed therebetween; a second pair of opposing, parallel receiver side elements each having a proximal end and an opposing distal end, the proximal end of each of the second receiver side elements attached to a corresponding one of the second receiver back element opposing vertical sides, each of the second receiver side elements extending generally perpendicularly from the second receiver back element, the second receiver back element and second receiver side elements forming a U-shaped cross section defining a second receiver channel; and a second pair of receiver outwardly angled elements each having a proximal end and an opposing distal end, the proximal end of each of the second receiver outwardly angled elements attached to the distal end of a corresponding one of the second receiver side elements, each of the second outwardly angled elements extending outwardly from the second receiver channel.

In another embodiment of the structural stud post assembly, the thermal break assembly comprises an insulating structural polymer.

In another embodiment of the structural stud post assembly, the insulating structural polymer is affixed to the receiver back element and the second receiver back element by an adhesive.

In another embodiment of the structural stud post assembly, the thermal break assembly further comprises a pour channel sized and shaped to accept the insulating structural polymer.

In another embodiment of the structural stud post assembly, each of the receiver back element and the second receiver back element are metal and the pour channel comprises a removable metal bridge connecting the receiver back element and the second receiver back element.

In another embodiment of the structural stud post assembly, when the removable metal bridge is removed, the structural stud post assembly does not comprise a thermally conductive metal contact path between the receiver back element and the second receiver back element.

DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Figure 1:
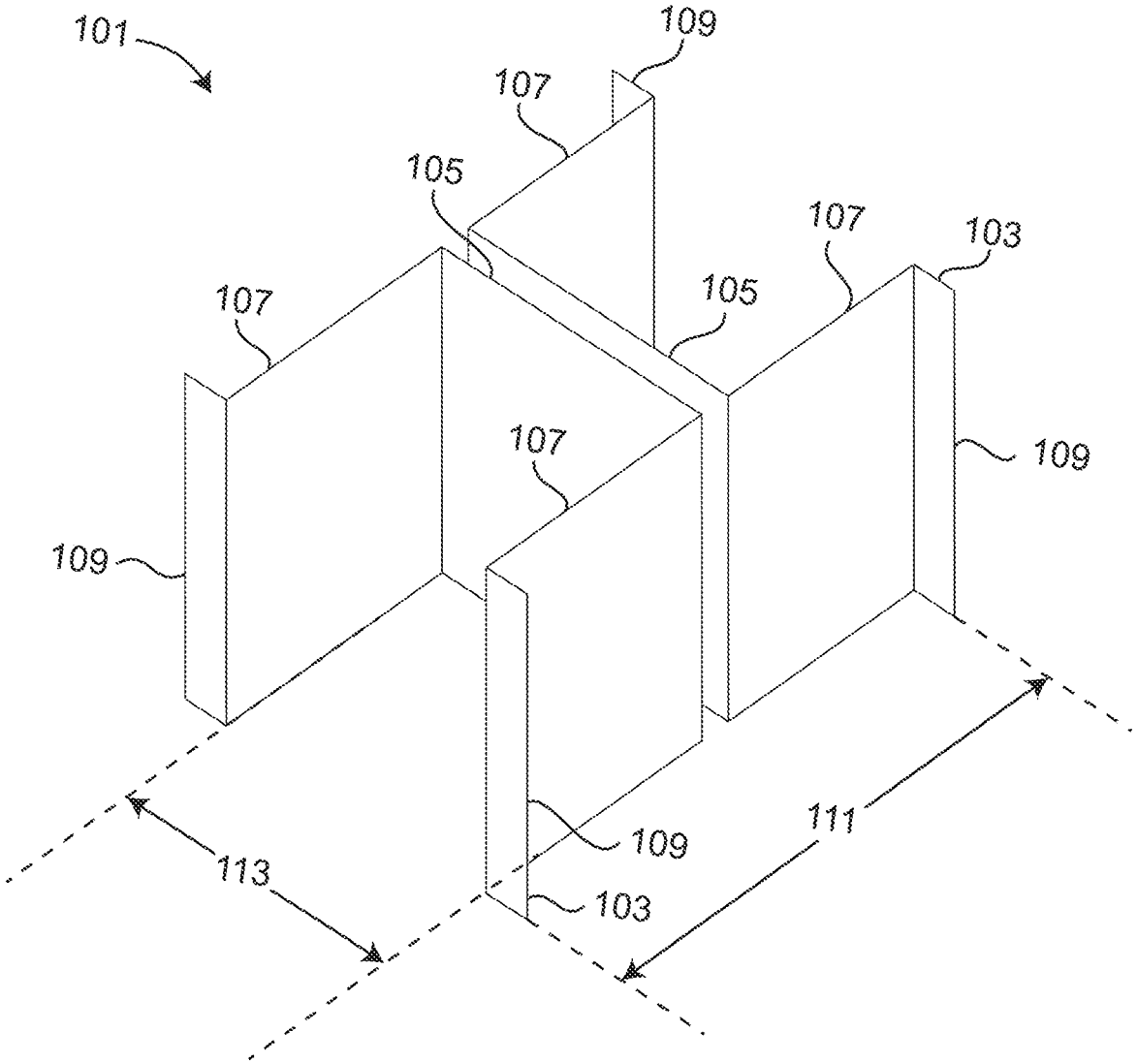
PRIOR ART FIG.1
FIG. 1 depicts a prior art structural stud post.
Figure 2:
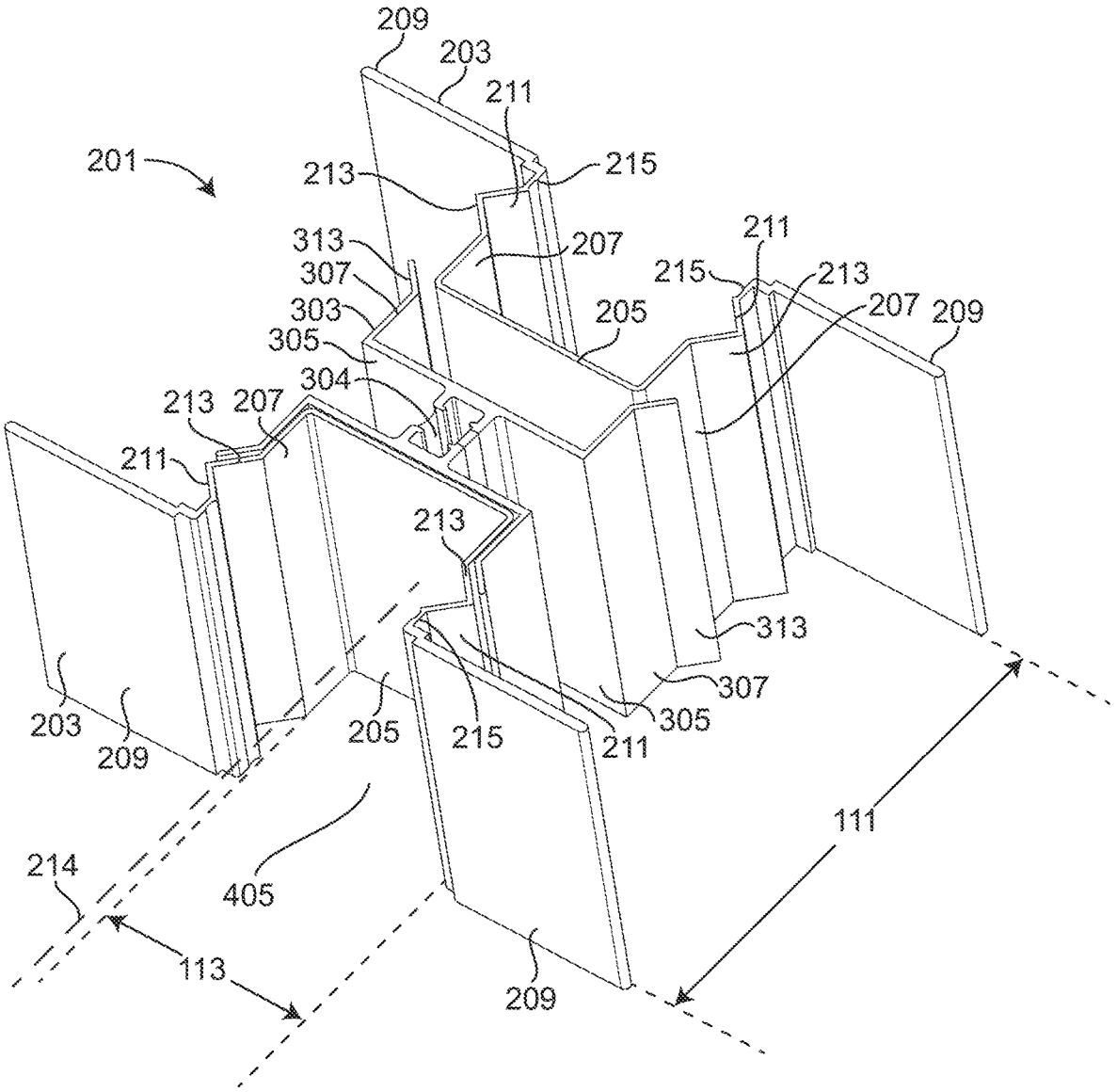
FIG. 2 depicts an isometric exploded view of a structural stud post according to the present disclosure.
Figure 3:
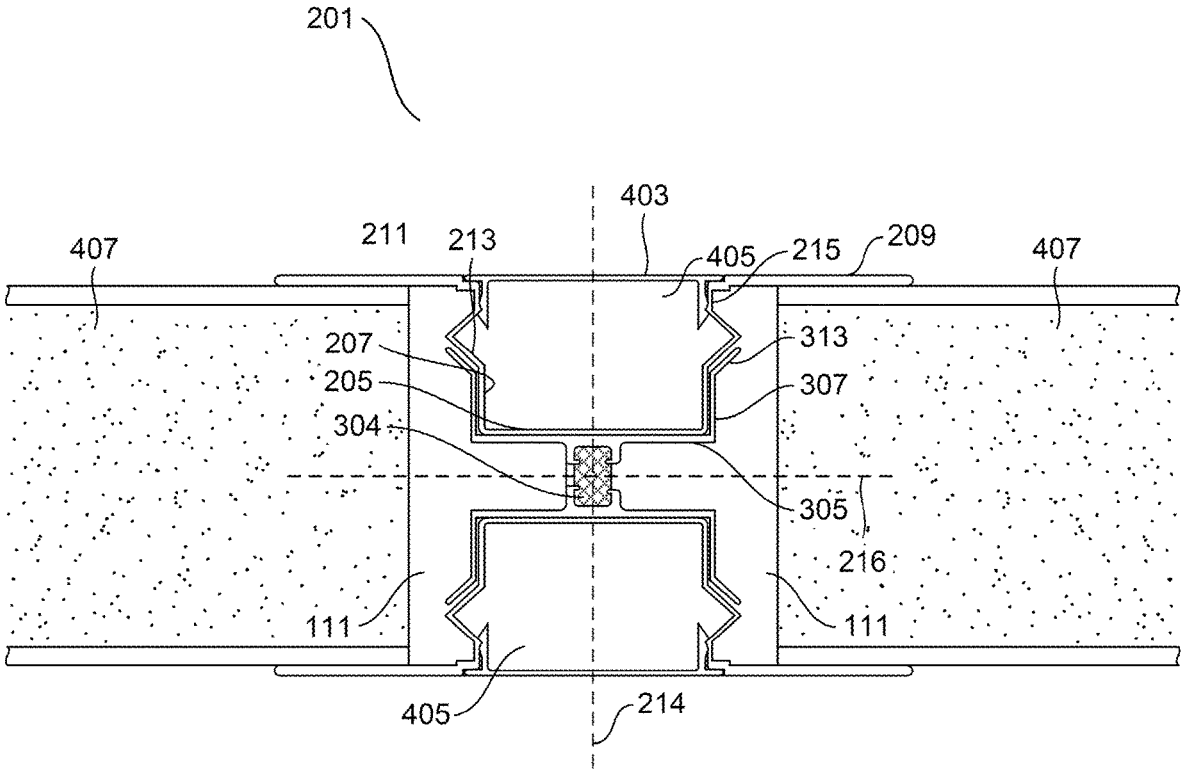
FIG. 3 depicts a top-down cross-sectional view of a structural stud post and wall system according to the present disclosure.
Figure 4:
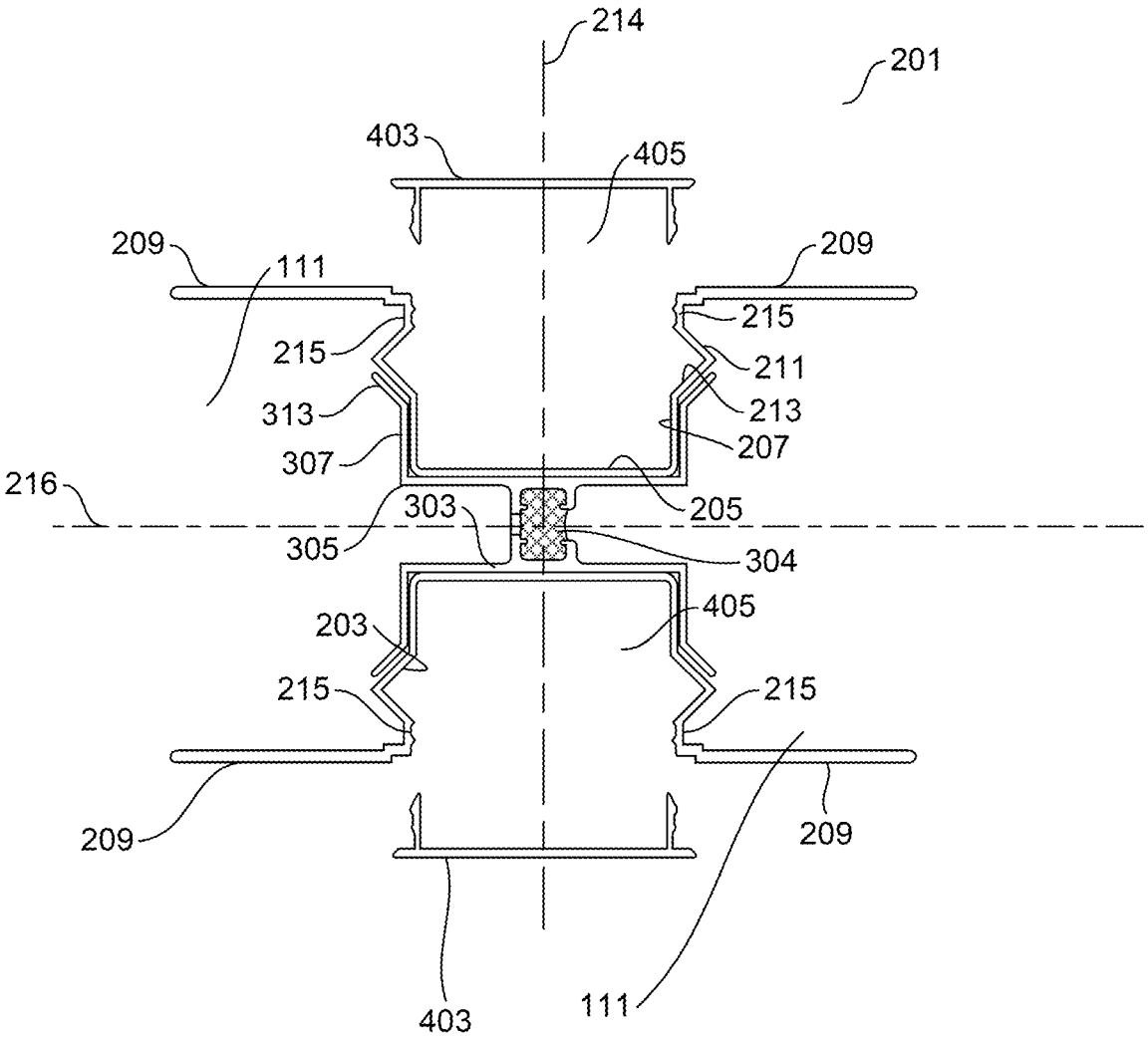
FIG. 4 depicts a top-down, partially exploded view of a structural stud post according to the present disclosure.

FIG. 2 depicts an isometric partially exploded view of an embodiment of a structural stud post (201) as described herein. The depicted structural stud post (201) comprises three or more individual members, including a pair of opposing outer raceway sections (203), and an interposed inner receiver section (303). FIG. 3 depicts a top-down cross-sectional view of an embodiment of a structural stud post, including wall panels. FIG. 4 depicts a top-down cross-sectional view of an embodiment of a structural stud, partially exploded.

Each of the depicted outer raceway sections (203) is generally in the same configuration, but is disposed in an opposing or mirrored orientation from each other when assembled. Each depicted outer raceway section (203) comprises a back element (205) attached at its opposing lateral or side edges two opposing side elements (207) extending therefrom, such that the back element (205) and side elements (207) together have a generally U-shaped cross section. The depicted side elements (207) are generally parallel from each other, and generally perpendicular to the back element (205), but this is by no means limiting, and other orientations and arrangements are possible. In an embodiment, the raceway sections may have differing configurations.

Each of the depicted side elements (207) has a proximal end attached to an edge of the back element (205), and an opposing distal end. In the depicted embodiment, each of the distal ends has an interior angled element (213) attached thereto, which flares outwardly from the direction of the midpoint (214) of the outer raceway sections (203). In the depicted embodiment, the angle is approximately 45 degrees, but this is exemplary only and other angles may be used in an embodiment. Each of the interior angled elements (213) has a proximal end attached to the distal end of the corresponding side element (207), and an opposing distal end. In the depicted embodiment, an exterior angled element (211) is attached to the distal end of each interior angled element (213), at an angle effective to cause a distal end of each exterior angled element (211) to be generally coplanar with the plane of the corresponding side element (207). This causes the combination of the interior angled element (213) and exterior angled element (211) to have a generally V-shaped cross section, as shown in FIGS. 2, 3, and 4. These elements will be understood as each being generally in the configuration of an elongated, thin rectangular prism, generally having a planar appearance extending from the floor track to the ceiling of a structure.

The depicted exterior angled elements (211) are attached to the interior angled elements (213) at a proximal end of each exterior angled element (211), and an opposing distal end of each exterior angled element (211) is attached to an exterior side element (215). Each depicted exterior side element (215) is generally coplanar with its corresponding first side element (207). Each of the depicted exterior side elements (215) is attached to the corresponding exterior angled element (211) at a distal end of the exterior angled element (211), and a distal end of each exterior side element (215) is attached to a flange (209). As can be seen in FIGS. 2, 3, and 4, the flange (209) extends outwardly from the midpoint (214) of the outer raceway section (203). The depicted flanges (209) are generally coplanar, generally parallel to the back element (205) and generally perpendicular to the side elements (207) and the exterior side elements (215). Again, this is by no means limiting and other configurations are possible.

The depicted inner receiver section (303) is be comprised of one or multiple components assembled to form a single logical inner receiver section. The depicted inner receiver section (303) is roughly in the configuration of an H. The sides of the H are the back elements (305) of the inner receiver section (303). Each of the depicted back elements (305) is an elongated planar element having a width slightly larger than the width of the back elements (205) of the outer raceway sections (203).

The depicted inner receiver section (303) further comprises a pair of opposing side elements (307) extending from the back elements (305) at opposing lateral ends or side thereof, generally parallel to each other, and generally perpendicular to the back element (305). As can be seen in FIGS. 2, 3, and 4, this provides a generally U-shaped cross section of the back element (305) and the side elements (307). The dimensions of these elements are slightly larger than those of corresponding structures of the outer raceway sections (203) so that the U-shaped cross section of the back element (205) and side elements (207) fits within the U-shaped formed by the back element (305) and side elements (307) of the inner receiver section (303). Likewise, at the distal ends of the side element (307) a first angled element (313) flares outwardly from the midpoint (214). The angle is generally the same as the angle at which the interior angled elements (213) flare from the side elements (207) of the outer raceway sections (203). This, again, causes the outer raceway sections (203) to fit within the corresponding elements of the inner receiver section (303).

The depicted inner receiver sections (303) contain an opposing pair of these structures; that is, a pair of back elements (305), opposing side elements (307) and opposing first angled elements (313). These elements are disposed in opposing orientations, making the inner receiver section (303) roughly symmetric about a plane (216) bisecting the inner receiver section (303) laterally. In the depicted embodiments, disposed between the back elements (305) of the inner receiver section (303) is a thermal break (304). In the depicted embodiment, the thermal break (304) is formed by walls extending from the back sides of the back elements (305) in the opposite direction from the side elements (307). Thus, the walls forming a thermal break (304) extend towards each other and connect to define a cavity. This cavity may be filled with insulation or other appropriate material for establishing a thermal break.

The thermal break may be formed using any number of techniques known in the art, and/or comprised of any number of different materials known in the art. By way of example and not limitation, in an embodiment, the thermal break may comprise a reinforced polyamide bar disposed between the interior and exterior aluminum profiles, which creates an insulated barrier within the frame. The thermal break may further comprise a material installed in the frame that physically separates the interior portion of the framework from the exterior portion, causing the thermal pathway for heat energy transfer through the wall frame to become "broken." This material is generally a material that qualifies as having low thermal conductivity as defined by prevailing standards organizations. By way of example and not limitation, the material may be a plastic or non-metallic resin, but in any case, preferably a material having a conductivity of no more than 0.5 W/m.K.

In an alternative embodiment, and pour and de-bridge process may be used. For example, a channel may be formed to encapsulate an insulating material, such as a polymer. The channel may be conditioned to ensure proper adhesion of the insulating material, and then the insulating material is dispensed into the channel having a single bridge between two adjacent components to provide the thermal barrier. The insulating material may be engineered or designed to harden or solidify into a structural polymer. Finally, a mill may be used to remove the bridge and prevent any direct metal-to-metal contact and thereby establish the hardened insulating polymer as a structural thermal barrier.

The sizes, shaped, and dimensions of the various components may be configured or chosen so as to be effective to cause the raceways to be snugly disposed within the channels of the receivers. That is, the corresponding wall elements should generally be in contact, or nearly in contact, with one another with little or no gap between corresponding elements, as shown in, for example, the assembled embodiment of FIG. 3, but the fit is preferably not be so tight as to require an installer to deform the elements to achieve connection.

When the depicted structural stud post (201) is assembled, the corresponding outer raceway sections (203) are connected at their respective back elements (205) to a corresponding back element (305) of the inner receiver section (303). They may be affixed thereto using hardware, adhesive, or other affixation methods known in the art or in the future developed. Once assembled, the four flanges (209) are effectively disposed at opposing and opposite corners of the assembled stud post (201). This causes one of each of the opposing flanges (209) of the outer raceway section (203) to define a retaining channel (111) for the lateral edge of a modular wall segment. Because the assembled structural stud post (201) is symmetric about a middle plane (214), two such channels (111) are formed on opposing sides of the assembled structural stud post (201). Thus, as shown in FIG. 3, two wall segments (407) can be disposed generally coplanar and attached to the assembled structural stud (201).

As can be seen in FIGS. 3 and 4, each of the outer raceway sections (203) defines a raceway (405) into which wiring, cabling, and/or other electrical and communications equipment or components can be disposed. If the raceway is not used, or is only partially used, a cover (403) can be installed to hide the raceway (405). The cover (403) may be attached via hardware or may be configured to simply snap onto the raceway (405). The embodiment depicted in FIG. 3, is a top-down cross-sectional view of an assembled structural stud post installed in a wall system.

Figure 5:
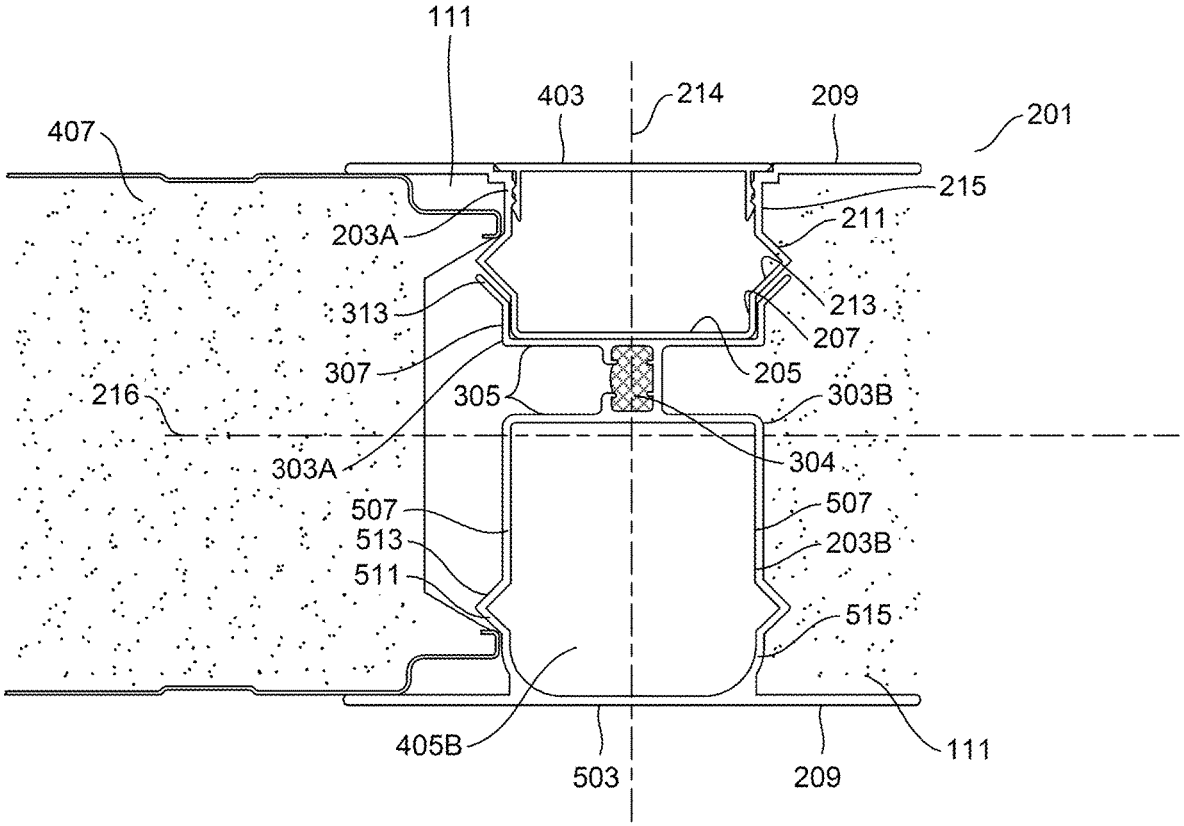
FIG. 5 depicts a top-down cross-sectional view of an alternative structural stud post according to the present disclosure, having only one raceway, and in use with a tongue-in-groove wall panel system.

FIG. 5 depicts an alternative embodiment of a structural stud post according to the present disclosure. In the depicted embodiment of FIG. 5, the assembly has only one raceway (405A) on one side, and the corresponding opposing space (405B), which would ordinarily function as a raceway, has a monolithically constructed cover (503). As can be seen in the depicted embodiment of FIG. 5, the structural stud post comprises, essentially, two members, including one outer raceway section (203A), and a combination inner receiver section (303)/enclosed raceway section (203B).

In the depicted embodiment, the outer raceway section (203) has generally the same configuration as described with respect to FIGS. 2, 3, and 4. In the depicted embodiment, the exterior side elements (215) are longer than depicted in the embodiments of FIGS. 2, 3, and 4, in order to accommodate the tongue-in-groove wall panel system (407).

In the depicted embodiment, the opposing side of the structural stud post (201) is an enclosed raceway section (303B) that does not have a corresponding outer raceway section as shown in FIGS. 2, 3, and 4, but rather is a similarly shaped, but enclosed element. This element includes a back element (305), but the side elements (507) are a similar monolithic construction, unlike in the outer raceway section (203A) which is shown as a physically separate element that fits within the inner receiver section (305).

The overall shape and configuration of the enclosed raceway section (303B) is similar, in that at the distal ends of the side elements (507) is disposed a pair of opposing interior angled elements (513), which flare outwardly from the direction of the midpoint (214) of the enclosed raceway section (303B). In the depicted embodiment, this angle is approximately 45 degrees, but this is exemplary only and other angles may be used in an alternative embodiment. Each of the depicted interior angled elements (513) has a proximal end attached to the distal end of the corresponding side element (507), and an opposing distal end.

In the depicted embodiment, a pair of opposing exterior angled elements (511) are attached to the distal end of each interior angled element (513), at an angle effective to cause a distal end of each exterior angled element (511) to be generally coplanar with the plane of the corresponding side element (507). As with the other embodiments, this causes a combination of the interior angled element (513) and an exterior angled element (511) to have a generally V-shaped cross-section, as shown in FIG. 5.

The depicted exterior angled elements (511) are attached to the interior angled elements (513) at a proximal end of each exterior angled element (511), and an opposing distal end of each exterior angled element (511) is attached to an exterior side element (515). Each of the depicted exterior side elements (515) is attached to the corresponding exterior angled element (511) at a distal end of the exterior angled element (511), and a distal end of each exterior side element (515) is attached to a flanged exterior surface (503).

Unlike in the previously described embodiments of FIGS. 2, 3, and 4, where the exterior is comprised of a pair of opposing flanges (209), with a removable cover (403) disposed between, in the depicted embodiment of FIG. 5, the flanged exterior side (503) is part of the single monolithic construction of the enclosed raceway element (303B), and comprises, effectively, a monolithic construction of the combination of the flanges (209) and the cover (403). As can be seen in the depicted embodiment, there is no removable element, and the enclosed raceway (405B) is effectively inaccessible. Also, as can be seen in the depicted embodiment, the side elements (515) include a curved element, but this is by no means necessary, and in alternative embodiments, the side elements may be straight or have other dimensions or shapes.

The total width of the flanged exterior side (503) is generally the same as the total width between the opposing ends of the flanges (209) of the outer raceway section (203) disposed on the opposing side of the structural stud post (201). Like the side elements (215) of the outer raceway section (203A), the side elements (515) of the enclosed raceway section (303B) are sized, shaped, and dimensioned to accommodate the tongue-in-groove wall panel system (407), as shown.

The depicted embodiment is exemplary only and in an alternative embodiment, different dimensions, shapes, or sizes may be used to accommodate a particular wall paneling system. Also, whereas the embodiments of FIGS. 2, 3, and 4 are generally symmetrical about the center plane (216), the depicted embodiment of FIG. 5 has a smaller, shallower outer raceway section (203A), as compared to the enclosed raceway section (303B). This is exemplary only, and not limiting, and, in an alternative embodiment, these two structures may be of approximately the same depth, or the outer raceway section may be deeper than the enclosed raceway section.

Figure 6:
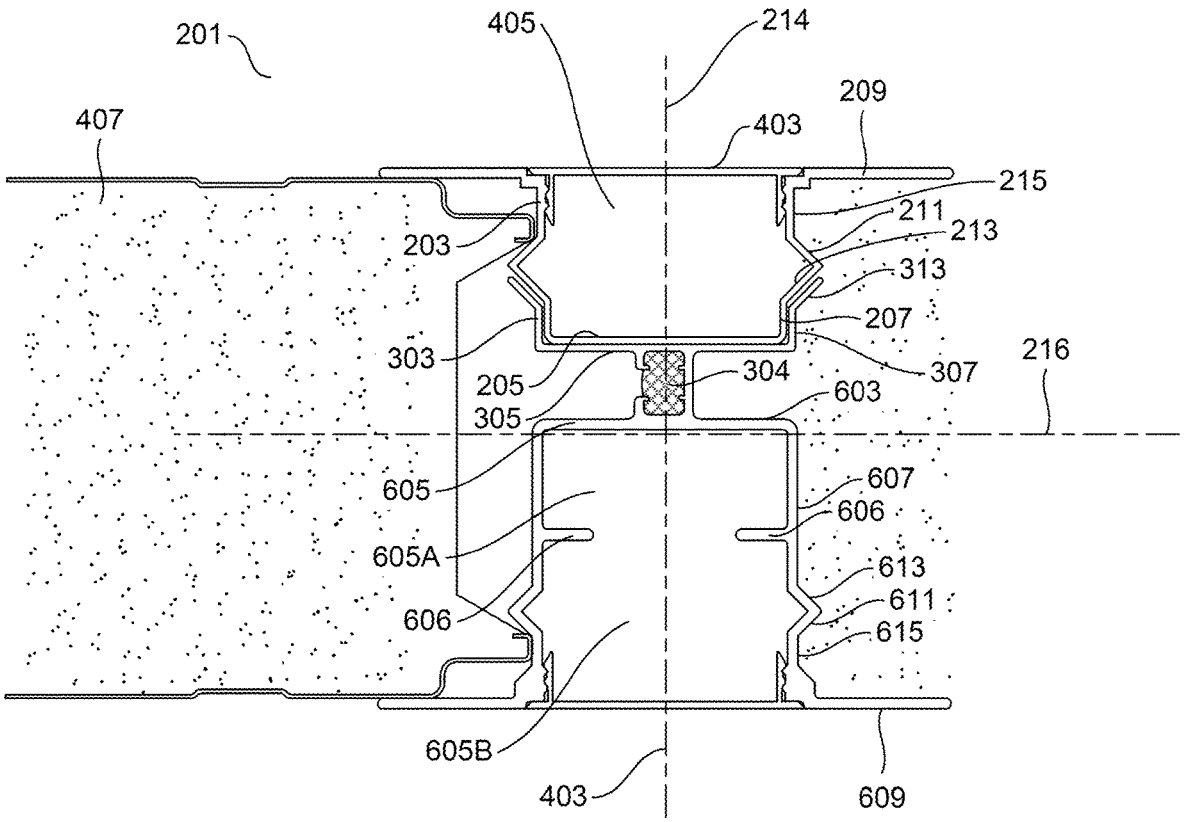
FIG. 6 depicts a top-down cross-sectional view of a further alternative structural stud post according to the present disclosure, having a single raceway and a dual raceway, and in use with a tongue-in-groove wall panel system.

FIG. 6 depicts a still further embodiment of a structural stud post according to the present disclosure. In the depicted embodiment of FIG. 6, the stud post (201) comprises two opposing outer raceway sections (203) and (603), with the first such section (203) having generally the configuration described in the embodiments of FIGS. 2, 3, and 4. However, in the depicted embodiment of FIG. 6, the second outer raceway section (603) does not comprise a separate removable raceway section, but rather it comprises a monolithic construction similar to that of the embodiment of FIG. 5, except that the exterior side (503) comprises a removable cover (403). Additionally, the depicted second outer raceway section (603) of FIG. 6 comprises two separate raceway sections enclosed within the structure: a first raceway section (605A) and a second raceway section (605B). These two sections are defined by a pair of opposing separators (606).

As can be seen in the embodiment of FIG. 6, the first raceway (605A) is disposed adjacent to the back (605) and the second raceway (605B) disposed adjacent to the first raceway (605A) and the removable cover (403). In the depicted embodiment, the raceway separators (606) are connected to the sides (607), and project orthogonally towards the midline (214). In the depicted embodiment, the separators (606) define an opening between their distal ends to provide access to the first raceway (605A). The depicted configuration is exemplary only, and, in an alternative embodiment, other configurations may be used, including, but not limited to, raceway separators (606) having a different shape, position, dimension, being nonsymmetrical, or being disposed in a manner other than orthogonal.

As can also be shown in the depicted embodiment of FIG. 6, the second outer raceway section (603) also comprises structures analogous to those depicted in other embodiments, including, but not necessarily limited to, the interior angled element (613), the exterior angled element (611), the exterior side element (615), and the flanges (609).

Figure 7:
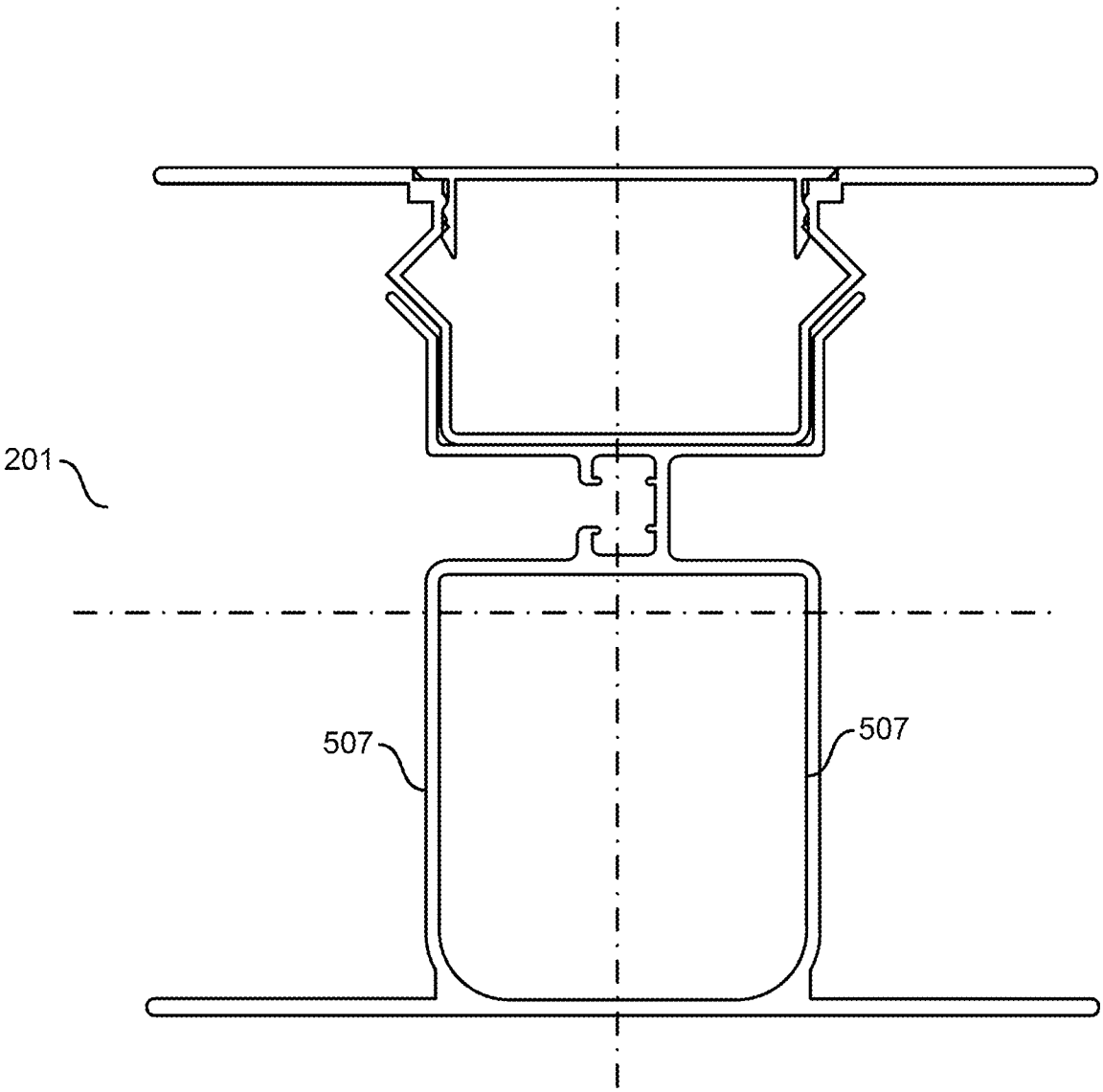
FIG. 7 depicts a top-down cross-sectional view of still further alternative structural stud posts according to the present disclosure, having various raceway configurations.

FIG. 7B depicts an alternative embodiment of a structural stud post (201) according to the present disclosure. The embodiment depicted in FIG. 7 is similar to the embodiment of FIG. 5, except that the sides (507) of the enclosed raceway section are straight, and do not have angled portions (513) and (511). Instead, the sides (507) adjacent to the back (505) continue into and merge with sides (515).

Figure 8A:
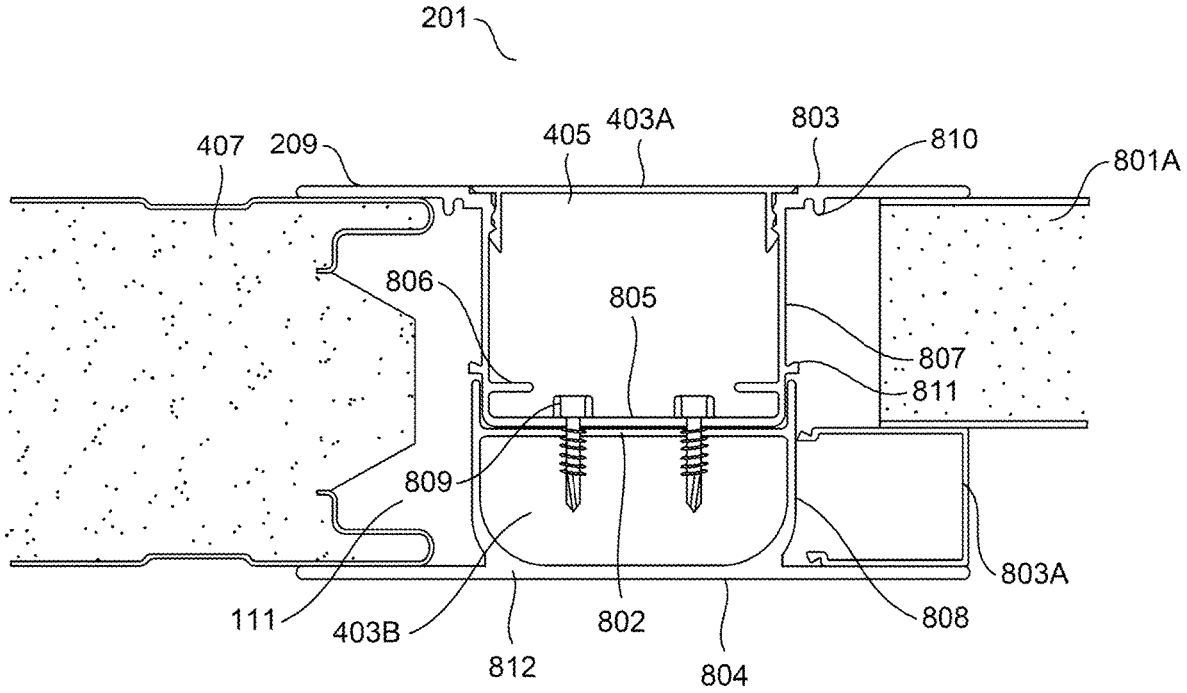
FIGS. 8A, 8B, and 8C depict top-down cross-sectional views of still further alternative structural stud posts according to the present disclosure, having a single raceway, and various configurations for use with tongue-in-groove wall panel systems and panel stops for use with panels of varying thicknesses.
Figure 8B:
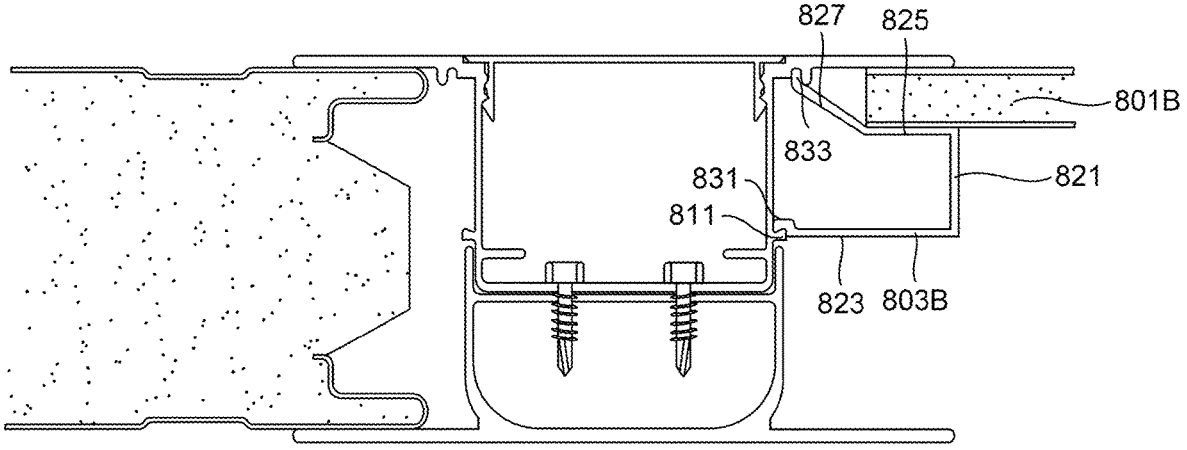
Figure 8C:
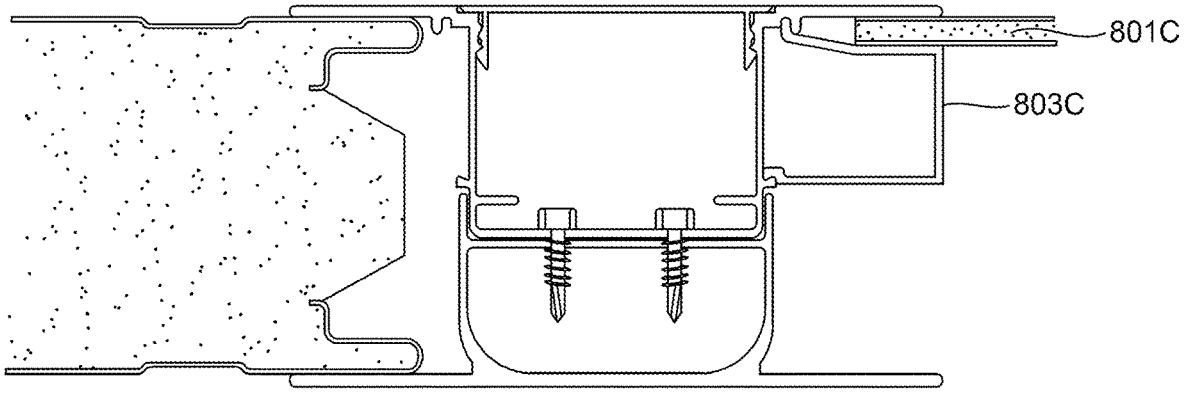

FIGS. 8A, 8B, and 8C depict various alternative embodiments, differing primarily in the size of the wall panel (407) used with the structural stud post, and the size and configuration of a panel stop used to support each of the different wall panel thicknesses.

Figure 9A:
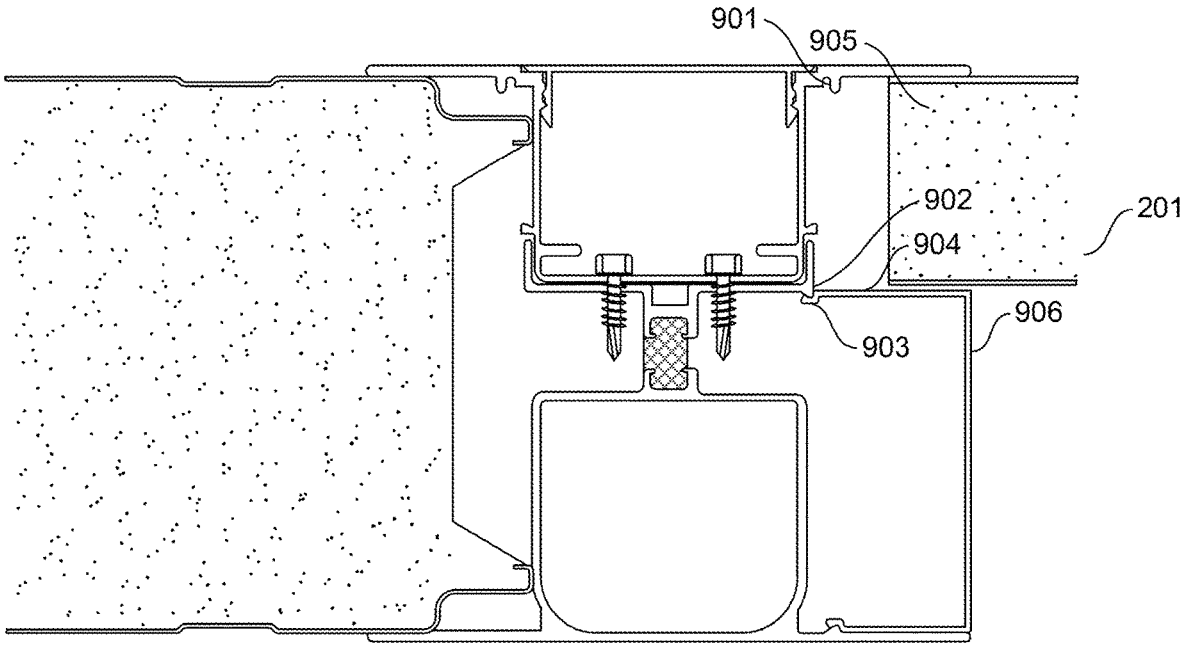
FIGS. 9A, 9B, and 9C depict top-down cross-sectional views of still further alternative structural stud posts according to the present disclosure, having a single raceway, in use with a tongue-in-groove wall panel system, and having various structures for panels of varying thicknesses.
Figure 9B:
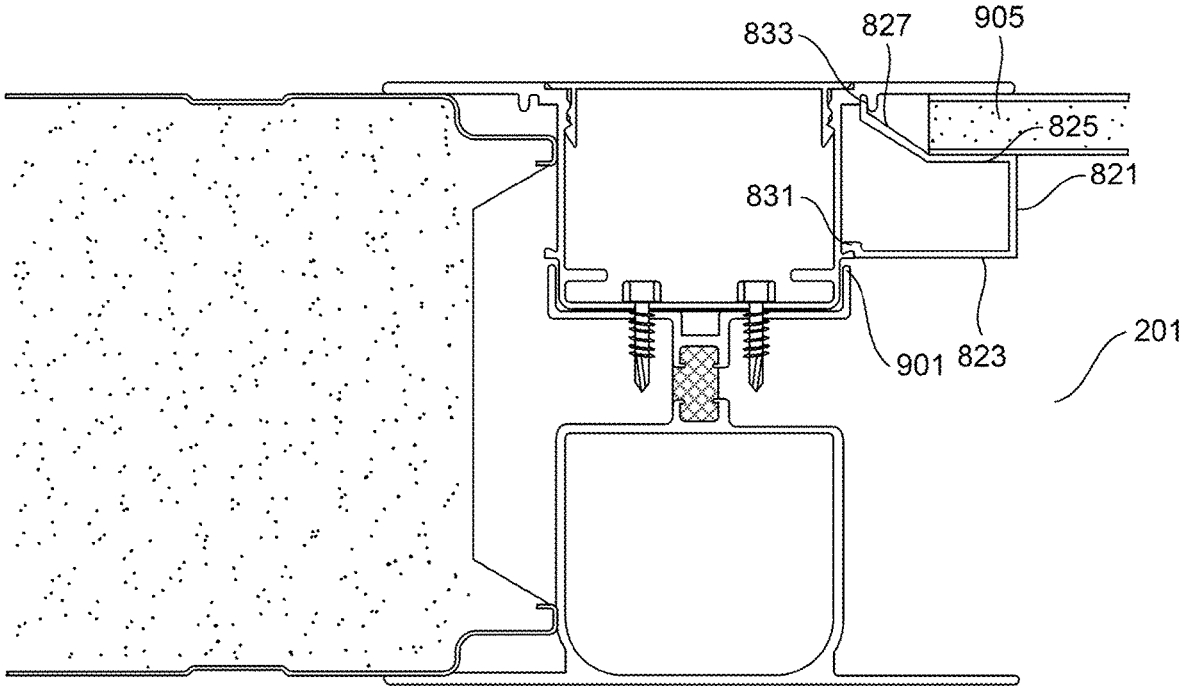
Figure 9C:
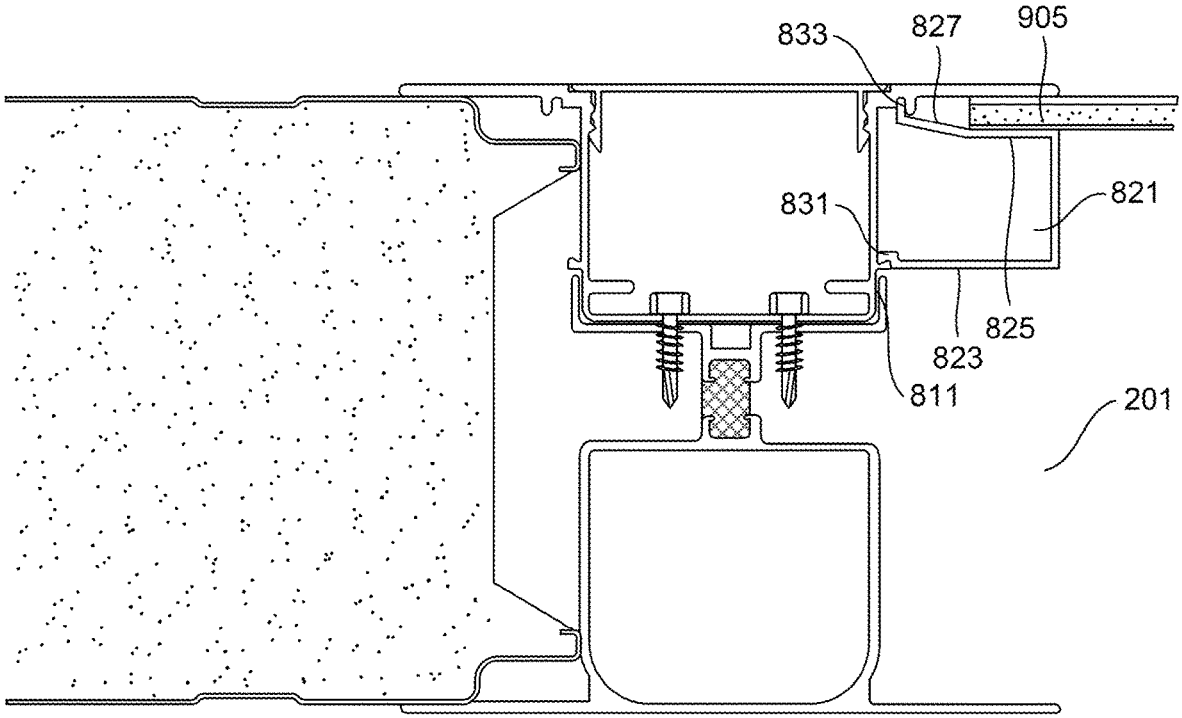

The depicted embodiments of FIGS. 8A, 8B, and 8C differ in that they do not include the thermal element, but, in alternative embodiments, a thermal break as described herein may be included as shown, for example, in FIGS. 9A, 9B, and 9C. In the depicted embodiments, the structural stud post (201) comprises two component elements: a first raceway portion (803), and a second raceway portion (804). The depicted first raceway portion (803) comprises a back side (805) with a pair of opposing and perpendicularly attached sides (807). A proximal end of the sides (807) is connected to the back side (805), and an opposing distal end of the sides (807) is attached to an end of a flange (209), which extends outwardly from a midline of the post (201), generally perpendicularly. Disposed between the flanges (209) is an opening which provides access to the internal raceway defined by the back side (805) and the side elements (807). The depicted embodiment further comprises a removable cover (403A) as described elsewhere herein.

Also shown in the depicted embodiment is a pair of opposing separators (806) disposed near the back side (805). The separators define a compartment adjacent to the back side (805). This compartment provides sufficient clearance for the head of a fastener or plurality of fasteners (809) used to attach the first raceway portion (803) to the enclosed raceway portion (805). In the depicted embodiment, the fasteners are screws, but other methods of fastening the two components together may be used.

The second raceway portion (403B) has a configuration similar to that depicted in the second raceway of FIGS. 5 and 7, in that the raceway comprises a back (802), a pair of opposing sides (808), and a monolithic construction with an exterior side (812). The depicted exterior side (812) is similar in shape and dimension to the combination of the flanges (209) and the cover (403) when installed. Thus, the interior defined by the back (802), sides (808), and exterior (812) define an enclosed internal raceway (403B). As shown in FIG. 8A, this structure is used to contain the puncturing ends of the fasteners.

Also shown in FIG. 8A is a pair of wall panels (407) and (801A) installed in association with the post (201). In the depicted embodiment, one such wall panel (407) is sized and shaped to be received within the cavity (111) defined by the flange (209) and the corresponding and opposing flange element of the exterior surface (802). However, on the opposite side of the post, the wall element (801A) has a thickness less than the distance between the flange (209) and the exterior (812).

In order to install and hold the wall element (801A) in place, a panel stop (803A) may be inserted between the wall element (801A) and either the flange (209) or the exterior surface (812). In the depicted embodiment, the panel stop has a generally U-shaped cross-section, with one leg of the U braced against the interior side of the flange (209) or exterior surface (812), and the other leg braced against a side of the wall panel (801A). In the depicted embodiment, the total thickness of the wall panel, and the length of the bottom of the U-shape of the panel stop (803A) is the same as the width of the cavity defined by the flange (209) and the exterior (812). Thus, no additional bracing is needed for the panel stop (803A) to hold the wall panel (801A) in place. For example, if the stud post is configured for use with a 3"-thick panel (407), and a 1⅞" panel (801A) is used, then the length of the base of the panel stop (803A) will be 1⅞".

FIG. 8B depicts the embodiment of FIG. 8A, except in use with a smaller wall panel (801B) and an alternative configuration of the panel stop (803B). In the depicted embodiment of FIG. 8B, the panel stop has a generally U-shape, except that one leg of the U is bent at an angle. That is, the panel stop has a base side (821), and a first leg (823) attached generally perpendicularly to the base side (821). The depicted panel stop (803B) also has a second leg (825), also attached perpendicularly to the base side (821), but the depicted second leg (825) is shorter than the first leg (823). The depicted panel stop (803B) further comprises an angled element (827) attached to the second leg (825) and flaring outwardly from the midline. In the depicted embodiment, the thickness of the panel (801B) is much smaller than the overall depth of the stud post, and the panel stop (803B) is configured to hold the thin panel (801B) in place without having to brace itself against both the panel (801B) and one of the flanges. Instead, the distal ends of the leg (823) and the angled element (827) comprise connecting elements (831) and (833). These connecting elements (831) and (833) are sized, shaped, and configured to interlock with corresponding connecting elements (811) and (810) disposed on the interior side of the flange and on the exterior side of the wall (807).

As can be seen in FIG. 8B, the connecting element (833) on the distal end of the angled element (827) is a rounded tip configured to be received within a detent on the flange. The panel stop (803B) is held in place by the connecting element (831) at the distal end of the longer leg (823). This element has an angled bottom surface that interlocks with a corresponding angled surface on the connecting element (811), which inhibits the panel stop from moving.

Similarly, in FIG. 8C, an even smaller panel (801C) is shown with an alternative arrangement of a panel stop (803C). The depicted panel stop (803C) of FIG. 8C has a generally similar configuration to the panel stop (803B) of FIG. 8B, but the angle of the angled element (827) is shallower, in order to configure the smaller leg (825) to brace against the thinner panel element (801C).

In this fashion, the same embodiment of the stud post (201) can be used to hold a plurality of different panel thicknesses, ranging from a full width panel (407), to panels having a variety of thicknesses which are less than that of the depth of the stud post (201).

FIGS. 9A, 9B, and 9C depict a still further embodiment of a stud post (201). In the depicted embodiments of FIGS. 9A, 9B, and 9C, a stud post with a thermal break, and having a configuration similar to that of FIG. 7 as well as 8A, 8B, and 8C, is shown. In the depicted embodiment, there is an open raceway element, similar to that shown in FIGS. 8A, 8B, and 8C, and an opposing enclosed raceway element, similar to that in FIG. 7. Situated between these elements is a thermal break. The enclosed raceway is monolithically constructed with the receiver for the outer raceway element, with a thermal break disposed therebetween. In the depicted embodiment, the thermal break comprises a full separation between the metallic elements. That is, the thermal break material is filled, and the connecting element between the closed raceway element, and the opposing receiver, is broken.

In this embodiment, the outer raceway element is attached to the receiver via fasteners, as shown and described with respect to FIGS. 8A, 8B, and 8C. Otherwise, the embodiments of FIGS. 9A, 9B, and 9C contain elements, such as the panel stops, that are similar to FIGS. 8A, 8B, and 8C. Of note, in FIG. 9A, the panel stop (906) is braced against both an attaching element (901) on the inside of the flange, and a corner (902) of the exterior of the receiver. In the depicted embodiment, this corner (902) includes a raised element with an angled surface, unto which the connecting element (903) at the distal end of the panel stop (906) leg (904) can latch in order to inhibit movement. This configuration facilitates a static hold of the depicted panel (905), similar to that shown in FIG. 8A, except that the embodiment of FIG. 9A would generally be deeper. For example, in FIG. 9A, the depicted post may be used with a 5" panel (905), meaning that to hold an installation of a 1⅞" panel (905), the panel stop (901B) must have a base width of about 3⅛".

Similarly, FIGS. 9B and 9C depict embodiments of the panel stop used in connection with the stud post similar in configuration to those depicted in FIGS. 8B and 8C. Embodiments of FIGS. 9A, 9B, and 9C also depict the use of a thermal break as described elsewhere herein in conjunction with the panel stops and a tongue-in-groove panel system.

It should be noted that although tongue-in-groove panels are depicted and described, the posts in question may be used with any type of panel, including but not necessarily limited to a sandwich panel for all depicted embodiments.

Throughout this disclosure, terms such as "generally," "about," and "approximately" may be used, such as, but not necessarily limited to, with respect to geometric terms, including shapes, sizes, dimensions, angles, and distances. One of ordinary skill in the art will understand that, in the context of this disclosure, these terms are used to describe an attempt by a person of ordinary skill in the art to cause the component in question to be recognizable as conforming to the qualified term. By way of example and not limitation, components described as being "generally coplanar" will be recognized by one of ordinary skill in the art to not be actually coplanar in a strict geometric sense because a "plane" is a purely geometric construct that does not actually exist and no component is truly "planer," nor are two components ever truly coplanar.

Variations from geometric descriptions are unavoidable due to, among other things, manufacturing tolerances resulting in shape variations, defects, imperfections, non-uniform thermal expansion, natural wear, and other deformations. Further, there exists for every object a level of magnification at which geometric descriptors no longer apply due to the nature of matter. Thus, one of ordinary skill in the art will understand how to apply relative terms such as "generally," "about," and "approximately" to describe a reasonable range of variations from the literal geometric meaning of the qualified term in view of these and other context-specific considerations. Additionally, the use of the conjunctive and disjunctive should not necessarily be construed as limiting, and the conjunctive may include the disjunctive, and vice versa.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A wall system comprising:

a structural stud post assembly having a thermal break comprising:

a receiver section comprising a center bar having a thermal break assembly disposed therein, said center bar having two pairs of parallel legs extending perpendicularly from opposing sides of said center bar, each of said two pairs of parallel legs having a pair of parallel side elements extending perpendicularly outwardly from a distal end of each leg of said each two pairs of parallel legs;

a first pair of parallel side elements of said parallel side elements forming a channel on a first side of said center bar; and each parallel side element of a second pair of said parallel side elements having a flange element perpendicularly disposed at a distal end of said each parallel side element, said flange elements being coplanar and extending outwardly from said distal ends of said parallel side elements; and a raceway section comprising a bottom and two raceway legs, each of said two raceway legs having a proximal end attached to said bottom, and an opposing distal end, each of said two raceways legs extending in parallel from said bottom and having a raceway flange perpendicularly attached to said distal end of each of said two raceway legs, said raceway flanges being coplanar and extending outwardly from said distal ends, wherein said U-shaped cross section is sized and shaped to fit snugly into said channel.

2. The wall system of claim 1, wherein said thermal break assembly comprises an insulating structural polymer.

3. The wall system of claim 2, wherein said thermal break assembly further comprises a pour channel sized and shaped to accept said insulating structural polymer.

4. The wall system of claim 3, wherein each of said two pairs of parallel legs are made of a metal, and said pour channel comprises a removable metal bridge connecting said opposing pairs of legs, wherein when said removable metal bridge is removed, said structural stud post assembly does not have a thermally conductive metal contact path between said opposing pairs of legs.

5. The wall system of claim 1, wherein each parallel side element of said second pair of parallel legs comprises an interior angled element and exterior angled element.

6. The wall system of claim 1, further comprising a cover sized and shaped to fit between said flange elements.

7. The wall system of claim 6, wherein said cover can be removably snapped into position between said flange elements.

8. The wall system of claim 7, further comprising a pair of opposing separators attached to said parallel side elements of said second pair of parallel legs at an interior side of said each parallel side element and projecting inwardly towards each other.

9. The wall system of claim 6, wherein said cover is monolithically constructed with said parallel side elements of said second pair of parallel legs and said flange elements.

10. The wall system of claim 9, wherein said cover, said parallel side elements of said second pair of parallel legs, and said flange elements define a raceway enclosure.

11. The wall system of claim 1, wherein when said structural stud post assembly is assembled, a first flange element of said flange elements and a first raceway flange element of said raceway flange elements extend generally in parallel from a first lateral side of said assembled structural stud post.

12. The wall system of claim 11, further comprising at least one wall segment attachable to said assembled structural stud post at said first lateral side.

13. The wall system of claim 12, wherein said at least one wall segment has a thickness about the same as a distance between said first flange element and said first raceway flange element.

14. The wall system of claim 12, wherein said at least one wall segment has a thickness less than a distance between said first flange element and said first raceway flange element, and said wall system further comprises at least one panel stop.

15. The wall system of claim 14, wherein when said at least one wall segment is attached to said assembled structural stop post and said at least one panel stop is installed, said at least one wall segment is held in place by said at least one panel stop.

16. The wall system of claim 15, wherein when said at least one wall segment is attached to said assembled structural stop post and said at least one panel stop is installed, movement of said at least one wall segment is inhibited by said at least one panel stop.

17. The wall system of claim 16, wherein said at least one panel stop is a generally U-shaped element and a leg of said generally U-shaped element is braced against an interior side of said first raceway flange element.

18. The wall system of claim 16, wherein said at least one panel stop is a generally U-shaped element and a leg of said generally U-shaped element is braced against a side of said at least one wall segment.

19. The wall system of claim 16, wherein said at least one panel stop is a generally U-shaped element and a leg of said generally U-shaped element comprises a connecting element at a distal end thereof, said connecting element configured to interlock with a corresponding connecting element of said assembled structural stud post.

* * * * *